US006615631B2

(12) United States Patent
Kleber et al.

(10) Patent No.: US 6,615,631 B2
(45) Date of Patent: Sep. 9, 2003

(54) PANEL EXTRACTION ASSIST FOR SUPERPLASTIC AND QUICK PLASTIC FORMING EQUIPMENT

(75) Inventors: Richard Murray Kleber, Clarkston, MI (US); Nelson T. Brinas, Sterling Heights, MI (US); Dana W. Moore, Rochester Hills, MI (US); Donald L. Kenyon, Sunfield, MI (US); Joseph B. Harris, Westland, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/837,597

(22) Filed: Apr. 19, 2001

(65) Prior Publication Data

US 2002/0152783 A1 Oct. 24, 2002

(51) Int. Cl.[7] ..... B21D 45/00
(52) U.S. Cl. ..... 72/60; 72/427
(58) Field of Search ..... 72/60, 63, 342.5, 72/427

(56) References Cited

U.S. PATENT DOCUMENTS

| | | | | | |
|---|---|---|---|---|---|
| 3,429,172 | A | * | 2/1969 | Lierse et al. | 72/427 |
| 3,529,458 | A | * | 9/1970 | Butler et al. | 72/60 |
| 5,819,572 | A | | 10/1998 | Krajewski | 72/42 |
| 5,944,646 | A | | 8/1999 | Weder et al. | 493/84 |
| 5,974,847 | A | | 11/1999 | Saunders et al. | 72/57 |

FOREIGN PATENT DOCUMENTS

| | | | | |
|---|---|---|---|---|
| GB | 1 231 428 | * | 5/1971 | 72/60 |

* cited by examiner

*Primary Examiner*—Lowell A. Larson
(74) *Attorney, Agent, or Firm*—Kathryn A. Marra

(57) ABSTRACT

Equipment and method for the rapid and easy extraction of formed metal parts from forming dies while in a press and operating at elevated temperatures. The invention features the controlled supply of streams of air or other inert gas to the interface of the hot surface of the forming die and the formed panel to augment removal so that flaws from removal equipment are minimized for optimized production of high quality parts. High velocity air is discharged through nozzles onto the forming surfaces of hot forming dies to cool the forming die and the part that contract at different rates and pop the part from the surface.

5 Claims, 3 Drawing Sheets

PANEL EXTRACTION ASSIST FOR SUPERPLASTIC AND QUICK PLASTIC FORMING EQUIPMENT

TECHNICAL FIELD

This invention relates to the art of manufacturing parts from metallic sheet material using hot metal forming dies and more particularly to new and improved constructions and techniques for producing metal parts featuring the rapid and trouble-free extraction of formed parts from hot working surfaces of superplastic and quick plastic forming dies.

BACKGROUND OF THE INVENTION

Prior to the present invention, various types of forming equipment and processes have been developed to form sheets of alloys of aluminum and other suitable metallic materials into a wide range of items such as sturdy and lightweight panels for vehicles. Among such equipment and processes are superplastic and quick plastic forming dies and processes in which a ductile sheet of suitable metallic material is heated and stretched onto the forming surfaces of heated dies to improve production of high quality parts. Examples of such processes and equipment are found in U.S. Pat. No. 5,974,847 issued Nov. 2, 1999 to Saunders et al for "Superplastic Forming Process" and U.S. Pat. No. 5,819,572 issued Oct. 13, 1998 to Krajewski for "Lubricating System for Hot Forming", both assigned to the assignee of this invention and both hereby incorporated by reference. In the patent to Saunders et al, a sheet of metal alloy is heated to a superplastic forming temperature and is pulled over and around a forming insert prior to using differential gas pressure to further stretch the sheet into conformity with a forming die surface so that thinning of the formed part is minimized. In the patent to Krajewski, dry lubricant is applied to metallic sheets which are subsequently heated to predetermined forming temperatures and formed into a part in superplastic forming die equipment. The lubricant initially provides improved forming of the part and subsequently improved release of the formed part from the forming die.

While such hot plastic forming processes and equipment generate improved parts, production efficiency has at times been diminished because of rejection of blemished or damaged parts produced by production procedures. Often such damage results from mechanical damage occurring from the physical removal of the formed part from the hot forming surface of the die and subsequently from the handling of the hot part. More particularly, after the part has been initially separated from the hot forming die, the part retains sufficient heat energy causing the surfaces thereof to retain some plasticity so that the tooling and handling marks may be imposed on the part from removal and stacking equipment.

Moreover, initial removal has heretofore been difficult because the formed part often firmly seats or grips on the die-forming surface. Dislodgment of such parts by extraction forces exerted through release tooling often results in part distortion or part marring by the tools or dies. This damage may be so substantial that parts do not meet specifications and have to be scrapped and recycled. The use of larger quantities of lubricants to improve parting requires more frequent and excessive die cleaning between forming operations and provides only minimized improvement in part removal. Often the lubricant remaining on the dies caused part imperfection on the show surfaces as pointed out in U.S. Ser. No. 09/748,096 filed Dec. 27, 2000 by Morales et al, entitled "Hot Die Cleaning for Superplastic and Quick Plastic Forming" and assigned to the assignee of this invention and hereby incorporated by reference.

SUMMARY OF THE INVENTION

In contrast to the prior art, the present invention is drawn to new and improved methods and mechanisms that provide improved parts and meets higher standards for ejection and removal of formed parts from hot superplastic and quick plastic forming dies while in the press and operating at elevated temperatures. More particularly, the invention is directed to the quick and effective removal of formed parts from hot forming dies without part damage and with optimized usage of parting lubricants.

This invention provides new and improved equipment and method for unseating the formed part from the heated die. In a preferred embodiment of this invention, a series of orificed air passages or jets extending through the forming surface of the die are employed to direct streams of compressed air between the die surface and the formed part. The pressurized air is effective at the interface between the forming surface and the formed part to provide an outwardly directed force, urging the formed part away from the forming surface of the heated die. The air passing through the jet orifices may accumulate between the formed part and the die surface to effectively reduce the amount of static friction that must be overcome in separating the two components.

Release air may also flow to the periphery of the formed part to break any sealing or loosen the seating between the part and the forming die to augment part release. Additionally, the air that passes through the orifices effectively cools the formed panel, which contracts at a high rate due to its high coefficient of thermal expansion and high surface area-to-mass ratio as compared to that of the die unit with its lower coefficient of thermal expansion and lower surface area-to-mass ratio. Since the die does not contract the same amount as the formed part, the difference in contraction reduces the area of intimate contact between the panel and the die surface, thereby reducing the amount of static friction that must be overcome in separating these two components from one another.

The above factors all contribute to the lowering of the force required to separate the formed panel from the die. This reduction in force allows the formed part to be removed from the hot die without damage and with minimum effort and distortion. Moreover, since the panel has been cooled by the air streams, its plasticity is reduced and can be quickly handled with removal and stacking equipment with minimized damage. With improved part extraction, parting lubricant usage can be reduced for improved production efficiency and effective cost reduction.

These and other features, objects and advantages will become more apparent from the following detailed description and drawings in which:

DESCRIPTION OF THE PREFERRED EMBODIMENT

Figure 1:
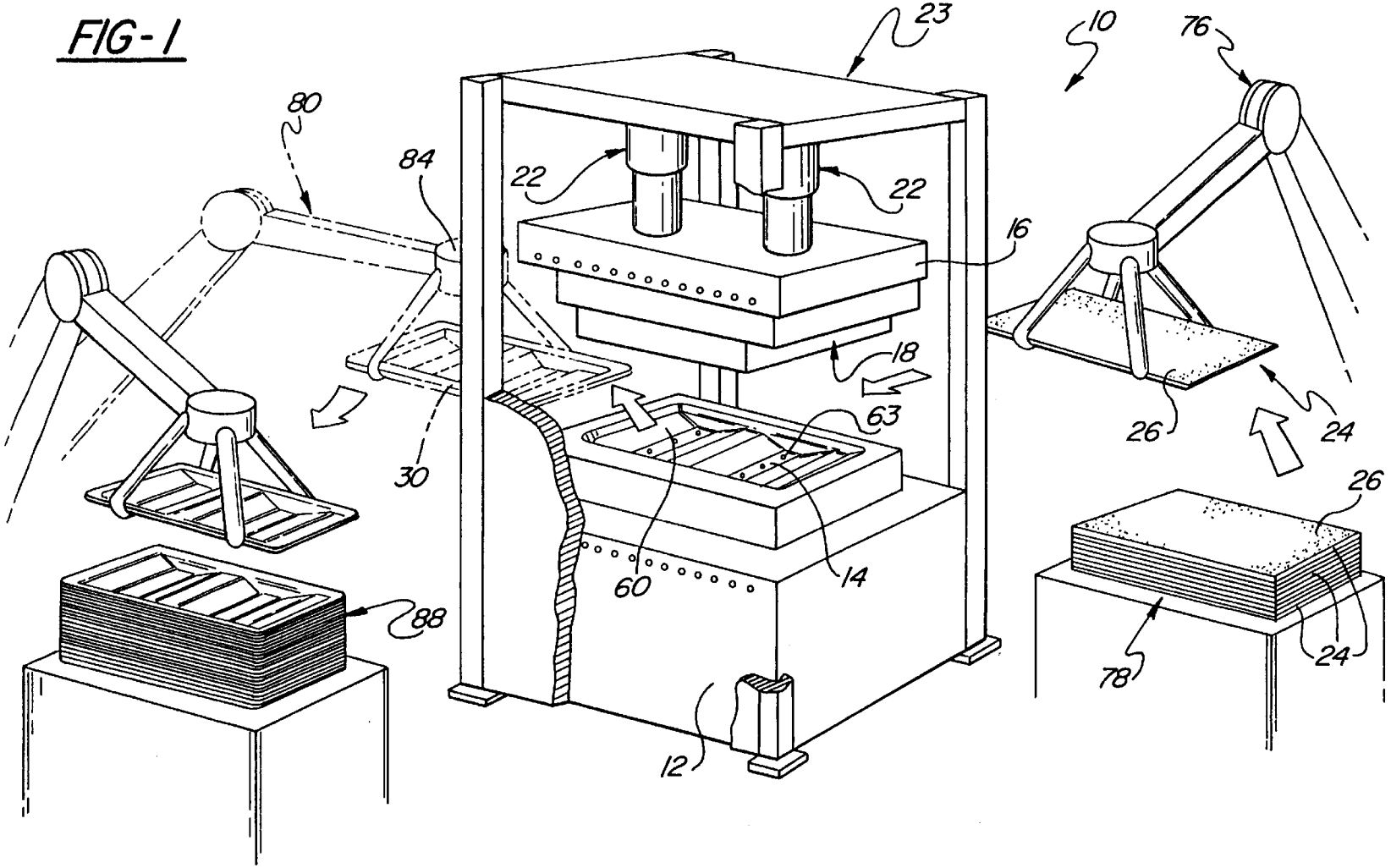
FIG. 1 is a pictorial view of an opened forming press with forming die equipment producing parts from sheet metal blanks.

Turning now in greater detail to the drawings, FIG. 1 illustrates a forming press 10 comprising a lower bolster plate 12 on which lower steel or forming die 14 is mounted. The press additionally has an upper reciprocating ram plate 16 that carries a chambered upper tool 18, which corresponds to the upper tool of the above-referenced U.S. Pat. No. 5,819,572. Both of the plates 12 and 16 are electrically heated to establish the required heat energy levels in the die and the sheet metal blanks 20 for superplastic forming or quick plastic forming as is known in this art. The forming die 14 can be mounted on the upper plate instead of the lower plate and the chambered upper tool 18 operatively supported on the lower plate if desired and depending on the characteristics of the part to be made.

The ram plate 16 is moved by hydraulic cylinders 22 to cycle the ram plate from the open position for blank loading to the closed blank forming position and then back to the open shown in FIG. 1 for formed part removal. The blanks 20 utilized with one preferred embodiment of this invention are flattened sheets 24 of aluminum alloy coated with a dry lubricant 26 such as boron nitride to function as a release agent to prevent the formed panel 30 from sticking to the die and furthermore to enhance the stretching and formation of the part during forming operation.

Figure 2:
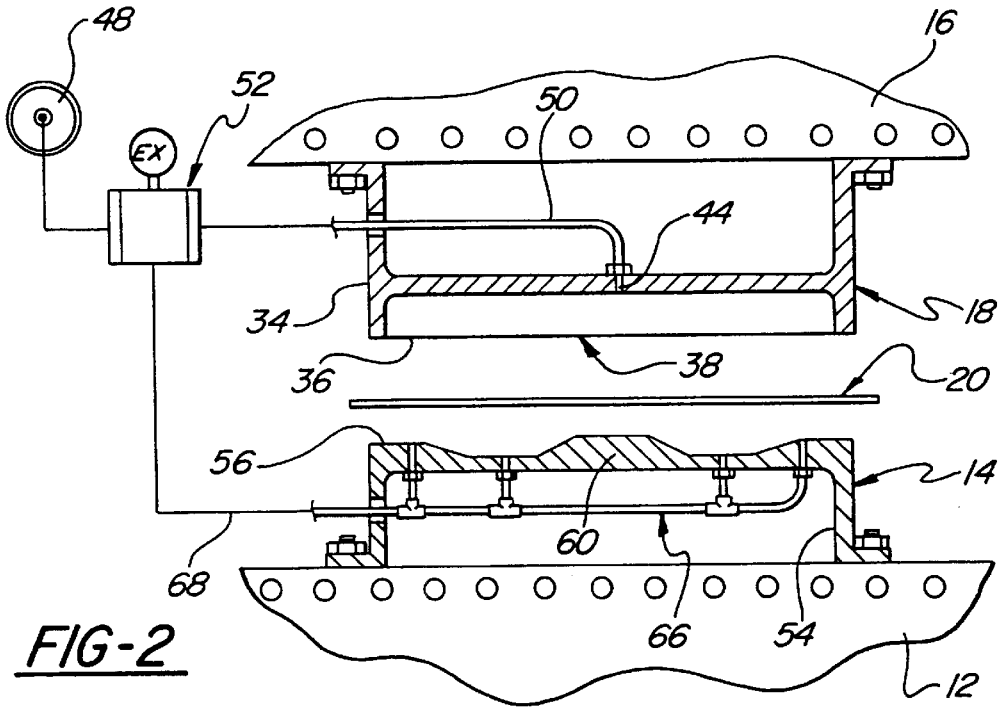
FIG. 2 is a diagrammatic cross-sectional view of the profiled hot dies as operatively mounted in the forming press of FIG. 1.
Figure 3:
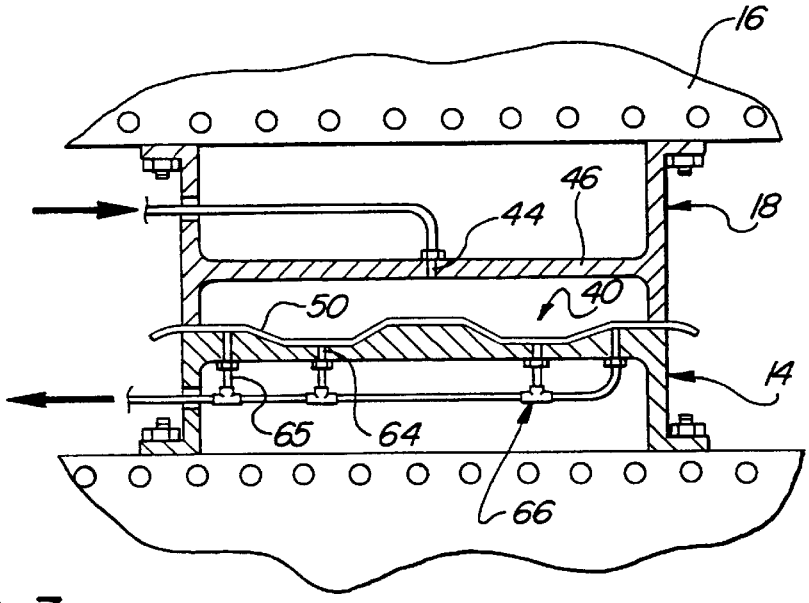
FIG. 3 is a diagrammatic cross-sectional view similar to the view of FIG. 2 but showing the forming die set in a forming position.
Figure 4:
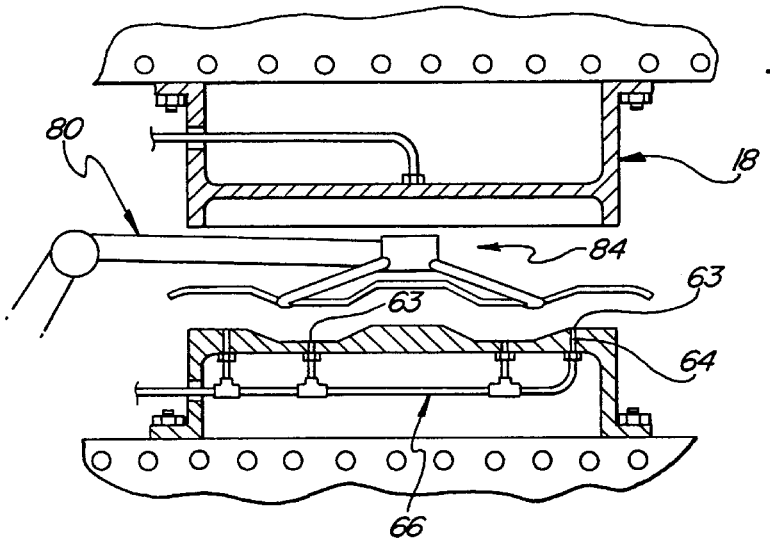
FIG. 4 is a cross-section view similar to the views of FIGS. 2 and 3 but showing the profiling dies in a part release position.

As shown best in FIGS. 2–4, the upper tool 18 is operatively connected to the lower face of the ram plate and projects downwardly therefrom. This tool has downwardly extending and rectilinear peripheral wall 34 whose free end 36 provides a continuous face seal 38 which sealingly engages the upper surface of the metal sheet 24 to define an air chamber 40 (see FIG. 3) when the upper tool is brought into engagement therewith during a part-forming operation. The air chamber 40 is supplied with pressurized air through an orifice 44 in an internal upper wall 46 connecting the sidewalls. The orifice is fed with pressurized air from a compressor or other source 48 operatively connected thereto by air line 50 and pneumatic controls 52 provided with conventional air control valves therein to control the feed and exhaust of air from the upper and lower tooling for metal-forming operation.

The lower tooling or die steel 14 has a rectilinear peripheral wall 54 extending upwardly from connection with the face of the bolster plate 12 to a continuous peripheral edge 56 that has pneumatic sealing engagement with the bottom surface of the alloy sheet 24. The steel lower tool further comprises a thick main forming body 60 of a mass considerably greater than that of the thin metal blank sheet 20. The upper surface of the main body of the forming die is profiled to form the desired shape of the part to be made. The main body is further provided with a plurality of air passages 64 therein that have small diameter orifices 63 formed at strategic locations in the forming surface of the die. As shown, the air passages pneumatically connect to lower fittings 65 of a manifold 66. The manifold pneumatically connects to the controls 52 by air line 68.

In operation, a loading arm 74 of a robot 76 or other suitable loading unit picks up a sheet 24 of aluminum alloy from a stack 78 of the blank sheets and moves and releases the sheet into operative position in the opened forming die unit of the forming press 10. The heated ram and bolster plate elevates and maintains the temperature of the upper and lower tools at a suitable forming temperature so that the temperature of loaded sheet quickly rises to the desired heat energy level for metal forming. The loading arm is removed and cycled to pick up a new sheet. With the sheet in position, the hydraulic cylinders 22 are operated by pressure controls for the press, not illustrated, to move the chambered upper tool 18 downwardly from the FIGS. 1 and 2 position to the forming position in FIG. 3. The controls 52 are then activated to charge the sealed chamber 40 with pressurized air or other inert forming gas that expands to fully stretch the sheet around the profile of the forming die to effect the forming of the panel or part 30. During such forming, the lower air passages 64 are open to exhaust so that there is no entrapment of gas pockets below the formed part to possibly distort portions thereof during forming thereof. After the panel is formed, the controls 52 are active to exhaust the upper chamber 40 and to pressurize the interface between the formed panel and the profiling surface of the forming die to augment panel release. Press controls are operated to open the press to move the upper forming chamber to the position of FIGS. 1 and 2. Robot arm 80 then extends and the gripping end 84 thereof grips the formed part 30 and removes it to a completed stack 88 for subsequent handling.

Figure 4A:
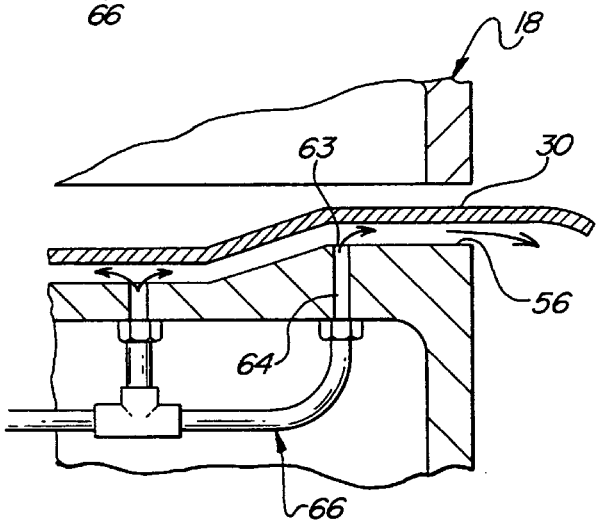
FIG. 4*a* is a portion of the profiling dies just prior to part release.

Part removal is enhanced since just prior to the entry of the removal arm into the open press, the controls direct streams of pressurized air into the body of the lower steel die via the manifold. The injected air under the panel tends to break any sealing between the panel and the forming die as diagrammatically illustrated in FIG. 4*a* and further provides a lifting force that urges the panel from the die as best illustrated in FIG. 4. Moreover, since the aluminum sheet has a much smaller mass and thickness and a larger thermal conductivity as compared to the mass, thickness and the thermal conductivity of the steel forming die, the sheet cools at a rate substantially higher than that of the die. With this differential, the panel quickly shrinks relative to the die so that it is no longer the same size as the die and splits therefrom. This further enhances extraction by the robot arm 80 as illustrated in FIG. 4. With the panel cooled, its rigidity is increased, providing for improved removal by the robot arm, particularly eliminating panel deformations previously experienced with removal of parts in which substantial heat energy remains in the formed part. With this invention, removal time is shortened so that press cycling time is shortened to optimize part production.

Figure 5:
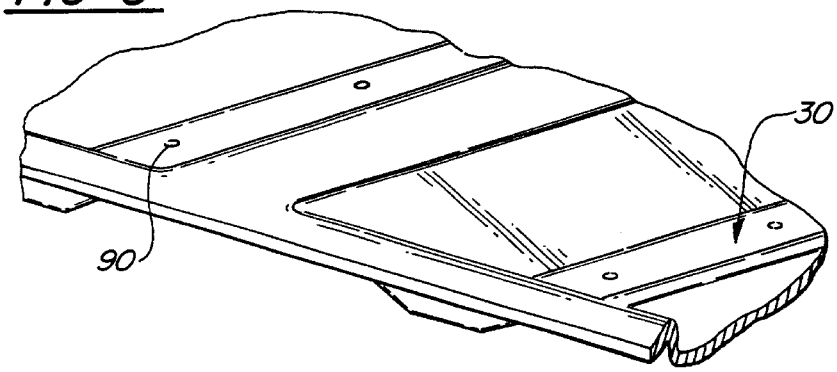
FIG. 5 is a diagrammatic pictorial view of a portion of a part produced by the present invention.

FIG. 5 illustrates the part 30 with some dimpled configuration 90 induced by air distributed through the orifices 63 that may be formed on the outer surface of the part. In such cases, the air passages are strategically located so that that they are hidden in recesses for molding strips, cutouts or other non-observable areas in finished panels or other plastically-formed parts.

While some preferred methods and mechanisms have been disclosed to illustrate the invention, other methods and mechanisms embracing the invention can now be adapted by those skilled in the art. Accordingly, the scope of the invention is to be considered limited only by the following claims.

What is claimed is:

1. A method of forming sheet metal parts with discrete primary outer surfaces that will be finished for optimized visual appearance and with secondary outer surfaces that will be visually hidden utilizing superplastic forming equipment including a profiling die operatively mounted in a press comprising the steps of:

a. installing a sheet of superplastic forming metal in the forming equipment over the profiling die;

b. heating the forming equipment so that the temperature of said sheet reaches a predetermined temperature for plastic forming;

c. closing the press with said sheet operatively contacting the profiling die of the sup erplastic forming equipment;

d. injecting pressurized gas into the forming equipment to effect the stretching of the sheet on the profiling die to plastically form a sheet metal part having said predetermined primary and secondary outer surfaces;

e. opening the press;

f. injecting streams of pressurized gas through the profiling die that are only directed onto locations on said formed part beneath said secondary surfaces for the pneumatic cooling of said formed part and effect an outward force on and the physical lifting of said part from the profiling die without deforming and degrading said primary outer surfaces of said formed part.

2. A method of plastically forming sheets of metal alloy into formed sheet metal parts with discrete first outer surfaces that will be visually observed and with discrete second outer surfaces that will be hidden when said parts are finished utilizing multi-component superplastic forming equipment including a profiling die having a mass greater than that of the individual sheets being formed and having a profiling surface for profiling said sheets into a predetermined shape comprising the steps of:

mounting a sheet on to the profiling die, moving a second component of the equipment into a profiling position onto the sheet, employing pressurized gas to stretch the sheet so that it forms on the profiling die, relatively moving the components to separate the second component from the profiling die, injecting streams of a cooling gas through the profiling die and into the interface between the profiling die and beneath the second outer surfaces of the parts that will be hidden to provide a pneumatic parting force urging the formed part away from the profiling surface without the deformation of the first outer surfaces to be visually observed and to effect the cooling of the formed sheet at a rate higher than the cooling rate of the profiling die so that said formed sheet will contract at a rate greater than the rate of the profiling die to augment separation of said part from the profiling surface.

3. A method of plastically forming sheets of metal alloy into formed sheet metal parts having primary outer surfaces that will be finished for optimized visual appearance and secondary outer surfaces that will be visually concealed using superplastic forming equipment having a plurality of forming components including a metallic profiling die having a mass greater than the mass of each of the sheets, said profiling die having a profiling surface for profiling the sheets into a predetermined shape comprising the steps of: mounting a sheet on the profiling surface, heating the sheet and moving a second component of the equipment into a profiling position and into operative engagement with said sheet, employing pressurized gas to stretch the sheet into a predetermined shape as determined by the profiling surface of said die, moving the second component away from the profiling position, cooling said shaped sheet metal part by injecting streams of gas through the profiling surface solely to areas beneath said secondary outer surfaces to force the formed part from the profiling die without damage to the primary surface and thereby augment the removal of said parts from said profiling die.

4. A profiling die set for the superplastic forming of metal parts having primary outer show surfaces and secondary outer surfaces that will be visually hidden starting with blanks of metallic and plastically formable sheet material, said die set comprising first tooling with peripheral walls providing a continuous pneumatic seal and defining a pressure chamber, a profiling die having a first profiling surface area for profiling said primary outer show surfaces and a second profiling surface area that profiles said secondary outer surfaces of the part, said profiling die cooperating with the pressure chamber to define a support and forming station for each of said blanks provided thereto, a series of gas conducting passages extending through said profiling die and terminating only in said second profiling surface area that profiles the secondary outer surfaces of the formed metal part, said gas supply and controls further incorporating a manifold operatively coupled to the profiling die for the even distribution of pressurized gas to each of said passages and thereby supplying streams of pressurized gas providing pneumatic lifting forces operatively directed to said part containing said second outer surfaces to lift the formed part from the profiling die without distortion or damage to said first outer surfaces of said part and further effecting the cooling and contraction of the formed part relative to the profiling die to augment the removal of the formed part therefrom.

5. A metal forming die having a contoured profiling surface capable of being a level to plastically form a relatively thin sheet of plastically formable metal material into a formed part having first outer surfaces that will be visible and finished and second outer surfaces that will concealed, said die having first and second outer profiling areas respectfully corresponding to said first and second outer surfaces of said formed part, said die having a plurality of gas conducting passages with discrete inlets and extending therethrough terminating in gas distribution orifices only in the second profiling area beneath the second outer surfaces of said formed part and a manifold pneumatically connecting to the inlets of said gas conducting passage and operatively connected to a source of pressurized gas and operative to route pressurized gas to said gas conducting passages to thereby provide the force to physically urge the plastically formed part from the forming surface of the heated die without any distortion of the first surface areas of the formed part.

* * * * *